US012655566B2

(12) United States Patent
Kim et al.

(10) Patent No.: US 12,655,566 B2
(45) Date of Patent: Jun. 16, 2026

(54) LAUNDRY TREATMENT APPARATUS

(71) Applicant: LG ELECTRONICS INC., Seoul (KR)

(72) Inventors: Jinwoong Kim, Seoul (KR); Sungmin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 104 days.

(21) Appl. No.: 18/706,824

(22) PCT Filed: Oct. 11, 2022

(86) PCT No.: PCT/KR2022/015279
§ 371 (c)(1),
(2) Date: May 2, 2024

(87) PCT Pub. No.: WO2023/080458
PCT Pub. Date: May 11, 2023

(65) Prior Publication Data

US 2025/0043492 A1 Feb. 6, 2025

(30) Foreign Application Priority Data

Nov. 2, 2021 (KR) ..... 10-2021-0148579

(51) Int. Cl.
*D06F 37/26* (2006.01)
*D06F 37/30* (2020.01)
*D06F 39/14* (2006.01)

(52) U.S. Cl.
CPC ..... *D06F 37/265* (2013.01); *D06F 37/30* (2013.01); *D06F 39/14* (2013.01)

(58) Field of Classification Search
CPC ..... D06F 37/265; D06F 37/30; D06F 39/14
(Continued)

(56) References Cited

U.S. PATENT DOCUMENTS 5,916,274 A 6/1999 Lee et al.
7,975,514 B2 7/2011 Kim et al.
(Continued)

FOREIGN PATENT DOCUMENTS

CN 113005721 A 6/2021
EP 3108254 A1 12/2016
(Continued)

OTHER PUBLICATIONS

KR101498037B1—machine translation (Year: 2015).*
(Continued)

*Primary Examiner* — Tinsae B Ayalew
(74) *Attorney, Agent, or Firm* — Fish & Richardson P.C.

(57) ABSTRACT

A laundry treatment apparatus (a clothing processing apparatus) includes: a cabinet; a tub provided inside the cabinet; a drum which is rotatably provided inside the tub and provides a space for storing clothing that is supplied via a tub inlet; a base which is provided in a ring shape surrounding the center of rotation of the drum and fixed to the drum; a balancer provided with a first surface, which is provided in a ring shape along the outer edge of the base, a second surface, which is provided in a ring shape along the inner edge of the base and forms a circulation path together with the base and the first surface, and a ball, which can move along the circulation path; and a fastening part which is provided in the base and fixes the balancer to the drum.

19 Claims, 9 Drawing Sheets

(58) Field of Classification Search
USPC ..... 68/23.2
See application file for complete search history.

(56) References Cited

U.S. PATENT DOCUMENTS

| | | | | |
|---|---|---|---|---|
| 8,522,580 | B2 | 9/2013 | Ryu et al. | |
| 2013/0205841 | A1 | 8/2013 | Kim et al. | |
| 2014/0190218 | A1* | 7/2014 | Jung | D06F 37/225 74/573.1 |
| 2016/0258102 | A1 | 9/2016 | Kim et al. | |
| 2020/0270799 | A1 | 8/2020 | Colin et al. | |

FOREIGN PATENT DOCUMENTS

| | | | |
|---|---|---|---|
| EP | 3279388 | A1 | 2/2018 |
| JP | 2019-523096 | A | 8/2019 |
| KR | 10-2010- 0129169 | | 12/2010 |
| KR | 10-1498037 | | 3/2015 |
| KR | 10-2025781 | | 11/2019 |
| RU | 2497990 | C1 | 11/2013 |
| WO | WO 2011/145049 | | 11/2011 |
| WO | 2018/026091 | A1 | 2/2018 |

OTHER PUBLICATIONS

Office Action in Russian Appln. No. 2024113517, mailed on Nov. 11, 2024, 11 pages (with English translation).
International Search Report and Written Opinion in International Appln. No. PCT/KR2022/015279, mailed on Jan. 26, 2023, 54 pages (with English translation).
Office Action in Japanese Appln. No. 2024-525569, mailed on Mar. 11, 2025, 8 pages (with English translation).
Extended European Search Report in European Appln. No. 22890193.0, mailed on Oct. 10, 2025, 10 pages.
Notice of Allowance in Australian Appln. No. 2022383620, mailed on Aug. 19, 2025, 3 pages.

* cited by examiner

LAUNDRY TREATMENT APPARATUS

CROSS-REFERENCE TO RELATED APPLICATIONS

This application is a National Phase application under 35 U.S.C. § 371 of International Application No. PCT/KR2022/015279, filed on Oct. 11, 2022, which claims the benefit of Korean Application No. 10-2021-0148579, filed on Nov. 2, 2021, the contents of which are incorporated by reference herein in their entirety.

TECHNICAL FIELD

The present application relates to an apparatus for treating laundry.

BACKGROUND ART

A laundry treatment apparatus may be a collectively referred to as a device for washing laundry or drying laundry, and objects (i.e., treatment target) washed or dried by the laundry treatment apparatus may include not only laundry but also all objects that are washable or dryable.

The laundry treatment apparatus may include a tub for storing water, a water supply unit for supplying water to the tub, a drain unit for discharging water from the tub, a drum provided in the tub to provide a space for storing laundry (e.g., a treatment target), and a communication hole provided in the drum to introduce the water stored in the tub into the drum.

The laundry treatment apparatus having the above-described structure rotates the drum in the tub in which water is stored, thereby removing foreign substances from laundry in the drum. Once the foreign substances are removed from the laundry, the water in the tub was discharged from the tub through the drain unit, and the drum is rotated inside the tub, from which the water has been discharged, to remove water from the laundry.

During the above-described process, vibration may occur in the drum. This is because, when the drum rotates at a high speed in a state in which the laundry is concentrated in a predetermined area of the drum, the drum is rotated in a state in which a dynamic equilibrium (or dynamic balance) is broken.

In the laundry treatment apparatus, when the mass distribution of the laundry around a rotation axis of the drum is within an allowable range when the drum rotates (e.g., when the drum rotates while vibrating within the allowable range), the state in which the mass distribution around the rotation axis of the drum is out of the allowable range during the rotation of the drum (e.g., a state in which the drum vibrates out of the allowable range) may be regarded as a dynamic imbalance state (e.g., unbalance). When the drum rotates in an unbalanced state, vibration generated in the drum may cause a problem of noise induction and durability degradation by vibrating the entire laundry treatment apparatus as well as the tub.

For unbalance control, the laundry treatment apparatuses of the related art have fixed a balancer to the drum (U.S. Pat. No. 8,522,580). The balancer included in the related-art laundry treatment apparatus may include at least one of a front balancer fixed to a front surface of the drum having a drum entrance and a rear balancer fixed to a rear surface of the drum to which a rotation shaft is fixed.

Each of the front balancer and the rear balancer includes a body in a ring shape fixed to the front surface of the drum or the rear surface of the drum, a circulation path provided in the body, and a ball provided to move along the circulation path. A rotation speed of the drum rotating in the unbalanced state changes depending on a position of the laundry causing the unbalance, When the rotation speed of the drum is lowered (e.g., when a centrifugal force acting on the ball is lowered), the balls move in the opposite direction to the position at which the laundry causing the unbalance is located, thereby reducing the eccentricity of the drum.

The front balancer is provided in a ring shape having an inner circumferential surface close to the drum entrance and an outer circumferential surface close to a circumferential surface of the drum, and the rear balancer is provided in a ring shape having an inner circumferential surface close to the rotation shaft of the drum and an outer circumferential surface close to the circumferential surface of the drum.

The balancers having the above-described structure are fixed to the drum through bolts connecting the outer circumferential surface and the circumferential surface of the drum. Since a centrifugal force acting along a diameter direction of the drum may be inputted to the ball when the drum rotates, fixing the outer circumferential surface of the balancer and the circumferential surface of the drum may be advantageous in preventing deformation of the body.

However, in the manner of fixing the outer circumferential surface of the body to the circumferential surface of the drum, a fixing body to which a fastener is fixed is required on the outer circumferential surface, and such a structure reduces a diameter of the circulation path, and the reduced diameter of the circulation path decreases the centrifugal force acting on the ball. The reduction of the centrifugal force acting on the ball means that a long time is required to resolve the unbalance state of the drum.

Meanwhile, according to a rear balancer (U.S. Pat. No. 7,975,514) of the related art, a body of a balancer is inserted into a recess formed on a rear surface of a drum, and the body is fixed to the recess with a shaft fixing part provided on the rear surface of the drum to have a rotation shaft of the drum fixed thereto. Although the balancer in this structure may prevent the above-mentioned disadvantages, there is a disadvantage in that a volume of the drum is reduced (i.e., treatment capacity is limited by the balancer).

DISCLOSURE

Technical Tasks

One technical task of the present application is to provide a laundry treatment apparatus having a balancer capable of quickly resolving an unbalanced state of a drum.

Another technical task of the present application is to provide a laundry treatment apparatus having a balancer capable of maximizing a centrifugal force acting on a ball while minimizing a decrease in volume of a drum.

Further technical task of the present application is to provide a laundry treatment apparatus having a balancer capable of minimizing degradation of durability due to a centrifugal force applied to a ball.

Technical Solutions

In one technical aspect of the present application, provided is a laundry treatment apparatus including a cabinet having an entrance, a tub provided in the cabinet to provide a space for storing water and having a tub entrance connected to the entrance, a drum rotatably provided in the tub to provide a space for storing laundry supplied through the tub entrance, a balancer including a base provided in a ring shape surrounding a rotation center of the drum and fixed to the drum, a first surface provided in a ring shape along an outer edge of the base, a second surface provided in a ring shape along an inner edge of the base to form a circulation path together with the base and the first surface, and a ball movable along the circulation path, and a fastening portion provided to the base to fix the balancer to the drum.

The drum may include a cylindrical drum body positioned inside the tub, a front cover positioned in a direction having the tub entrance provided therein in the drum body, a rear cover provided at a position opposite to the front cover, a communication hole passing through the drum body, and a drum entrance passing through the front cover to put laundry into the drum body, and the balancer may be fixed to the front cover.

The fastening portion may include a fixing body provided on the base and a fastening body fixing the fixing body to at least one of the drum body or the front cover.

A height of an uppermost end of the fixing body may be set to be smaller than that of an uppermost end of the first surface.

The front cover may include a front cover body having the drum entrance, a front mounting portion provided in a ring shape surrounding the drum entrance to the front cover body to have the base mounted thereon, and a front connection portion extending from the front mounting portion to come in contact with the drum body, and the fixing body and the front connection portion may be fixed to the drum body through the fastening body.

The fixing body may protrude from the base toward the front mounting portion and the front mounting portion may include a front mounting recess having the fixing body accommodated therein.

The laundry treatment apparatus may further include a first extension portion extending from the first surface toward the front mounting portion, and the fixing body may connect the first extension portion and the base.

The laundry treatment apparatus may further include a first connection surface located at a corner where the first surface and the base are connected and bent from the base toward the first body and a first support portion having one end fixed to the first extension portion and the other end fixed to the first connection surface to maintain a gap between the first extension portion and the first connection surface.

The laundry treatment apparatus may further include a protruding portion protruding from the second surface toward the drum entrance.

The laundry treatment apparatus may further include a second connection surface located at a corner where the second surface and the base are connected and bent from the base toward a direction having the second body located therein, a second extension portion extending from the protruding portion toward the front mounting portion and provided in a ring shape surrounding the drum entrance, and a second support portion having one end fixed to the second extension portion and the other end fixed to the second connection surface to maintain a gap between the second extension portion and the second connection surface.

A distance from the protruding portion to a free end of the extension portion may be equal to or more than half of a distance from the protruding portion to an outer circumferential surface of the base.

The support portion may further include an inclined portion connecting the connection surface from the free end of the extension portion.

A thickness of the second extension portion may be equal to or smaller than that of the second surface.

The drum may include a cylindrical drum body positioned inside the tub, a front cover positioned in a direction having the tub entrance provided therein in the drum body, a rear cover provided at a position opposite to the front cover, a communication hole passing through the drum body, and a drum entrance passing through the front cover to put laundry into the drum body, and the balancer may be fixed to the rear cover.

The fastening portion may include a rear fixing body provided to the base and a rear fastening body fixing the rear fixing body to at least one of the drum body or the rear cover.

A height of an uppermost end of the rear fixing body may be set to be smaller than that of an uppermost end of the first surface.

The laundry treatment apparatus may further include a driving unit configured to rotate the drum through a driving shaft fixed to the rear cover, the rear cover including a rear cover body having the driving shaft fixed thereto, a rear mounting portion provided in a ring shape surrounding the driving shaft to the rear cover body to provide a space having the base mounted therein, and a rear connection portion extending from the rear mounting portion to come in contact with the drum body, and the rear fixing body and the rear connection portion may be fixed to the drum body through the rear fastening body.

In another technical aspect of the present application, provided is a laundry treatment apparatus including: a drum having a cylindrical drum body, a front cover forming a front surface of the drum body, a rear cover forming a rear surface of the drum body, a communication hole passing through the drum body, and a drum entrance passing through the front cover to put laundry into the drum body; a driving unit rotating the drum; a first body having a base provided in a ring shape surrounding the drum entrance and located in a direction facing the front cover, a first surface provided in a ring shape along an outer edge of the base, and a second surface provided in a ring shape along an inner edge of the base; a second body closing a circulation path formed by the first surface, the second surface, and the base; a ball movable along the circulation path; and a fastening portion having a fixing body provided to the base and a fastening body fixing the fixing body to at least one of the drum body or the front cover.

In another technical aspect of the present application, provided is a laundry treatment apparatus including: a cabinet having an entrance; a tub provided in the cabinet to provide a space for storing water and having a tub entrance connected to the entrance; a drum having a cylindrical drum body located inside the tub, a front cover located in a direction having the tub entrance provided therein in the drum body, a rear cover located at a position opposite to the front cover, a communication hole passing through the drum body, and a drum entrance passing through the front cover to put laundry into the drum body; a driving unit rotating the drum; a first body having a base provided in a ring shape surrounding the drum entrance and located in a direction facing the front cover, a first surface provided in a ring shape along an outer edge of the base, and a second surface provided in a ring shape along an inner edge of the base; a second body closing a circulation path formed by the first surface, the second surface, and the base; a ball movable along the circulation path; and a fastening portion having a fixing body provided to the base and a fastening body fixing the fixing body to at least one of the drum body or the front cover.

The front cover may include a front cover body having the drum entrance, a front mounting portion provided in a ring shape surrounding the drum entrance to the front cover body to have the base mounted thereon, and a front connection portion extending from the front mounting portion to come in contact with the drum body, and the fixing body and the front connection portion may be fixed to the drum body through the fastening body.

The front mounting portion may include a recess formed by bending the front cover body toward the rear cover.

The fixing body may protrude from the base toward the front mounting portion and the front mounting portion may include a front mounting recess having the fixing body accommodated therein.

The laundry treatment apparatus may further include a first connection surface located at a corner where the first surface and the base are connected and bent from the base toward the first body and a first extension portion extending from the first surface toward the front mounting portion, and the fixing body may connect the first extension portion and the base.

A distance from the second body to a free end of the first extension portion may be set equal to a distance from the second body to an outer circumferential surface of the base.

The laundry treatment apparatus may further include a fixing body support portion connecting the first extension portion, the fixing body, and the base.

The laundry treatment apparatus may further include a first support portion having one end fixed to the first extension portion and the other end fixed to the first connection surface to maintain a gap between the first extension portion and the first connection surface.

The first support portion may include a multitude of ribs (i.e., first support plates) spaced apart from each other at the same interval with respect to a center of the drum entrance.

The laundry treatment apparatus may further include a protruding portion protruding from the second surface toward the drum entrance.

The laundry treatment apparatus may further include a second connection surface located at a corner where the second surface and the base are connected and bent from the base toward a direction having the second body located therein, a second extension portion extending from the protruding portion toward the front mounting portion and provided in a ring shape surrounding the drum entrance, and a second support portion having one end fixed to the second extension portion and the other end fixed to the second connection surface to maintain a gap between the second extension portion and the second connection surface.

A distance from the protruding portion to a free end of the extension portion may be equal to or more than half of a distance from the protruding portion to an outer circumferential surface of the base.

The second support portion may further include an inclined portion connecting the connection surface from the free end of the extension portion.

The second support portion may include a multitude of ribs (i.e., second support plates) spaced apart from each other at equal intervals based on a center of the drum entrance, and each of the ribs may be provided at a position spaced apart by 7° to 15° based on the center of the base.

A thickness of the second extension portion may be equal to or smaller than that of the second surface.

A thickness of the second extension portion may be set to 0.7 to 0.9 time of a thickness of the second surface.

A height of the second support portion connecting the second surface and the second extension portion may be set to 0.3 time or more of a distance from the protruding portion to a free end of the second extension portion.

A thickness of the second support portion may be set to ½ time of a thickness of the second surface.

In another technical aspect of the present application, provided is a laundry treatment apparatus including: a cabinet having an entrance; a tub provided in the cabinet to provide a space for storing water and having a tub entrance connected to the entrance; a drum having a cylindrical drum body located inside the tub, a front cover located in a direction having the tub entrance provided therein in the drum body, a rear cover located at a position opposite to the front cover, a communication hole passing through the drum body, and a drum entrance passing through the front cover to put laundry into the drum body; a driving unit rotating the drum through a driving shaft fixed to the rear cover; a rear first body having a rear base provided in a ring shape surrounding the driving shaft and located in a direction facing the rear cover, a rear first surface provided in a ring shape along an outer edge of the rear base, and a rear second surface provided in a ring shape along an inner edge of the base; a rear second body closing a rear circulation path formed by the rear first surface, the rear second surface, and the rear base; a ball movable along the rear circulation path; and a rear fastening portion having a rear fixing body provided to the rear base and a rear fastening body fixing the rear fixing body to at least one of the drum body or the rear cover.

The rear cover may include a rear cover body having the driving shaft fixed thereto, a rear mounting portion provided in a ring shape surrounding the driving shaft to the rear cover body to provide a space for mounting the rear base therein, and a rear connection portion extending from the rear mounting portion to come in contact with the drum body, and the rear fixing body and the rear connection portion may be fixed to the drum body through the rear fastening body.

The rear fixing body may protrude from the rear base toward the rear mounting portion and the rear mounting portion may include a rear mounting recess having the rear fixing body accommodated therein.

In further technical aspect of the present application, provided is a laundry treatment apparatus including: a cabinet having an entrance; a tub provided in the cabinet to provide a space for storing water and having a tub entrance connected to the entrance; a drum having a cylindrical drum body located inside the tub, a front cover located in a direction having the tub entrance provided therein in the drum body, a rear cover located at a position opposite to the front cover, a communication hole passing through the drum body, and a drum entrance passing through the front cover to put laundry into the drum body; a driving unit rotating the drum through a driving shaft fixed to the rear cover; a first body having a base provided in a ring shape surrounding the drum entrance and located in a direction facing the front cover, a first surface provided in a ring shape along an outer edge of the base, and a second surface provided in a ring shape along an inner edge of the base; a second body closing a circulation path formed by the first surface, the second surface, and the base; a ball movable along the circulation path; a fastening portion having a fixing body provided to the base and a fastening body fixing the fixing body to at least one of the drum body or the front cover; a rear first body having a rear base provided in a ring shape surrounding the driving shaft and located in a direction facing the rear cover, a rear first surface provided in a ring shape along an outer edge of the rear base, and a rear second surface provided in a ring shape along an inner edge of the base; a rear second body closing a rear circulation path formed by the rear first surface, the rear second surface, and the rear base; a ball movable along the rear circulation path; and a rear fastening portion having a rear fixing body provided to the rear base and a rear fastening body fixing the rear fixing body to at least one of the drum body or the rear cover.

Advantageous Effects

The present application provides a laundry treatment apparatus having a balancer capable of quickly resolving an unbalanced state of a drum.

The present application provides a laundry treatment apparatus having a balancer capable of maximizing a centrifugal force acting on a ball while minimizing a decrease in volume of the drum.

The present application provides a laundry treatment apparatus having a balancer capable of minimizing degradation in durability due to a centrifugal force acting on a ball.

BEST MODE

Hereinafter, embodiments of a laundry treatment apparatus will be described in detail with reference to the accompanying drawings.

Figure 1:
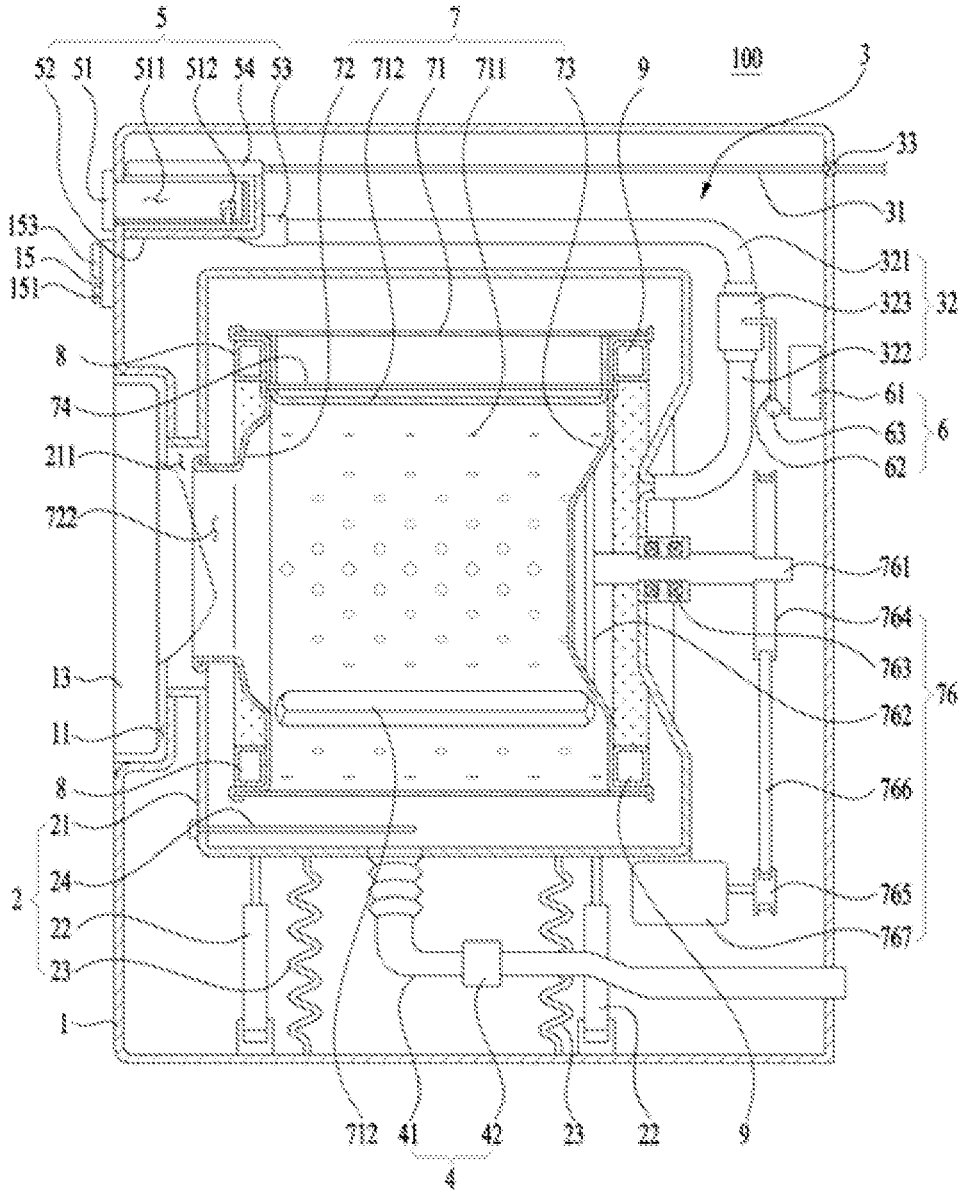
FIG. 1 is a diagram illustrating an example of a laundry treatment apparatus.

A laundry treatment apparatus 100 shown in FIG. 1 includes a cabinet 1, a tub 2 provided in the cabinet to provide a space in which water is stored, and a drum 7 rotatably provided in the tub to provide a space in which laundry is stored.

The cabinet 1 may be provided to form an exterior of the laundry treatment apparatus 100. An entrance 11 for guiding laundry to the tub 2 is provided on one surface of the cabinet, and FIG. 1 illustrates an example in which the entrance 11 is provided on a front surface of the cabinet 1 e.g., (a surface facing a front surface of the laundry treatment apparatus).

The entrance 11 may be opened or closed by a door 13 rotatably fixed to the cabinet 1. A control panel 15 is provided in a space above or below the entrance 11 on the front surface of the cabinet 1.

The control panel 15 may include an input unit 151 and a display unit 153. The input unit 151 may be a means for inputting a control command to a controller (not shown) through the control panel, and the display unit 153 may be provided as a means for displaying a control command selectable through the input unit and execution information of the control command selected through the input unit.

The tub 2 may include a cylindrical tub body 21 of which the inside is empty. The tub body 21 is fixed inside the cabinet 1 through a tub support portion, and FIG. 1 illustrates an example in which the tub support portion includes a damper 22 and a spring 23.

The damper 22 may be connected to a lower region of the tub body 21 and a bottom surface of the cabinet 1 to absorb vibration of the tub body 21. The spring 23 is a means for providing a restoring force for moving the tub body 21 to an initial position when there is no external force inputted to the tub body 21 (e.g., when the tub body does not vibrate).

The spring 23 may be provided to connect an upper region of the tub body 21 (e.g., a space located above a horizontal line passing through a center of the tub body) to an upper surface of the cabinet 1, or may be provided to connect the lower region of the tub body 21 to the bottom surface of the cabinet 1.

As the volume of the tub body 21 increases (e.g., as the treatment capacity of the laundry treatment apparatus increases), both the damper 22 and the spring 23 may be provided to connect the lower region of the tub body 21 to the cabinet, which is advantageous in controlling the vibration of the tub body 21.

A tub entrance 211 is provided on a front surface of the tub body 21. The tub entrance 211 should be connected to the entrance 11. Although the tub entrance 211 is shown as directly connected to the entrance 11 in FIG. 1, the tub entrance 211 and the entrance 11 may be connected through a corrugated tube made of rubber or the like (if the tub support portion of the above-described structure is provided, the corrugated tube may be removed).

A heater 24 may be provided in the tub body 21 to heat the water stored in the tub body 21.

The tub 2 may receive water through a water supply unit 3, and the water stored in the tub may be discharged to the outside of the cabinet 1 through a drain unit 4.

The water supply unit 3 may include a water supply pipe 31 and 32 connecting a water supply source and the tub body 21 and a water supply valve 33 opening and closing the water supply pipe, and the drainage unit 4 may include a drain pipe 41 guiding water in the tub body 21 to the outside of the cabinet 1 and a drain valve 42 controlling opening and closing of the drain pipe 41.

In order to supply detergent to the tub body 21, a detergent supply unit may be further provided in the laundry treatment apparatus 100. The detergent supply unit may include at least one of a first supply unit 5 and a second supply unit 6, and FIG. 1 illustrates an example in which both the first supply unit 5 and the second supply unit 6 are provided.

The first supply unit 5 may include a drawer 51 provided to be withdrawn from the cabinet 1 to provide a space for storing detergent and a drawer housing 52 provided in the cabinet to provide a space in which the drawer 51 is accommodated.

A draw-in/out opening for entry and exit of the drawer 51 may be provided in one surface of the cabinet 1, and FIG. 1 illustrates a case in which the draw-in/out opening is provided on the front surface of the cabinet 1.

The drawer 51 is provided with a chamber 511 for providing a space for storing detergent and a chamber outlet 512 for discharging the detergent in the chamber 511 to the drawer housing 52. The chamber 511 is provided in a structure in which an upper surface is open, and the chamber outlet 512 is a water trap (Siphon Flow Path) that discharges liquid in the chamber to the drawer housing when a water level in the chamber 511 exceeds a preset water level.

The drawer 51 is supplied with water through a nozzle 54 (positioned above the chamber) to form the upper surface of the drawer housing 52, and the liquid discharged to the drawer housing 52 through the chamber outlet 512 is discharged from the drawer housing 52 through a housing outlet 53. In this case, the water supply pipe may include a first water supply pipe 31 connecting the nozzle 54 and a water supply source and a second water supply pipe 32 connecting the housing outlet 53 and the tub body 21. Preferably, a water supply valve 33 may be provided to the first water supply pipe 31.

The second supply unit 6 may be provided to supply detergent to the tub 2 through the second water supply pipe 32.

The second water supply pipe 32 may include a first hose 321 connected to the housing outlet 53, a second hose 322 connected to the rear surface of the tub body 21, and a connector 323 connecting the two hoses. In this case, the second supply unit 6 includes a detergent storage unit 61 in which a liquid detergent is stored, a supply pipe 62 that connects the detergent storage unit to the connector 323, and a pump 63 configured to allow the detergent in the detergent storage unit 61 to move to the connector 323 through the supply pipe 62.

The second supply unit 6 may determine a detergent amount required according to an amount (i.e., laundry amount) of laundry put into the drum 7, and move the determined amount of detergent to the connector 323. For example, the amount of laundry is determined by the controller based on an amount of power supplied to a driving unit 76 to rotate the drum 7 at a predetermined angle, and the controller may control the pump 63 to move the detergent of the amount (i.e. a proper detergent amount according to the laundry amount) set through tests to the connector 323.

The drum 7 may include a cylindrical drum body 71 positioned inside the tub 2, a front cover 72 positioned in a direction in which the tub entrance 211 is provided in the drum body 71 (to form a front surface of the drum), and a rear cover 73 provided at a position confronting the front cover 72 to form a rear surface of the drum.

A multitude of communication holes 711 are provided in the drum body 71 so that the water stored in the tub 2 can be supplied into the drum 7, and the front cover 72 is provided with a drum entrance 722 for guiding the laundry put through the tub entrance 211 into the drum body 71.

A lifter 712 may be provided in the drum body 71. The lifter 712 may protrude from a circumferential surface of the drum body 71 toward the center of rotation of the drum body 71. During the rotation of the drum 7, the laundry repeats rising and falling within the drum 7 by the lifter 712, thereby promoting a process of separating foreign substances from the laundry.

As a volume of the drum 7 increases (as the treatment capacity of the laundry treatment apparatus increases), a large load (e.g., a frictional force between the water stored in the tub and the drum, the weight of the laundry stored in the drum, etc.) may be applied to the drum 7. In order to prevent degradation of durability of the drum 7 (e.g., preventing distortion of the drum, separation of the front or rear cover from the drum body, etc.), the drum 7 may further include a fixing shaft 74 for fixing the front cover 72 and the rear cover 73 to the drum body 21.

The fixing shaft 74 may include a bar having one end fixed to the front cover 72 and the other end fixed to the rear cover 73. The fixing shaft 74 may pass through the lifter 712 so that the fixing shaft 74 is not exposed to the inside of the drum body 71.

The drum 7 rotates through the driving unit 76. The driving unit 76 may include a driving shaft 761 fixed to the rear cover 73 and a motor 767 for supplying power required for rotation of the driving shaft 761.

The driving shaft 761 may pass through a rear surface of the tub body 21. In this case, the driving shaft 761 may be provided in parallel with the bottom surface of the cabinet 1 or may be inclined at an angle of less than 90 degrees with respect to the bottom surface of the cabinet 1.

The driving shaft 761 may have a structure directly connected to the motor 767. That is, when the motor 767 includes a stator fixed to the rear surface of the tub 2 to form a rotating magnetic field and a rotor rotated by the rotating magnetic field, the driving shaft 761 may have one end fixed to the rear cover 73 and the other end fixed to the rotor.

As shown in the drawing, the driving shaft 761 may be provided to receive power provided by the motor 767 through a pulley and a belt. In this case, a driving pulley 765 may be provided to a rotation shaft of the motor 767, a driven pulley 764 may be provided to the driving shaft 761, and the two pulleys 765 and 764 may be connected to each other through a belt 766.

The driving shaft 761 may be fixed to the rear cover 73 through a shaft fixing part 762.

When the driving shaft 761 is directly fixed to the center of the rear cover 73 without a separate device, stress is concentrated at the center of the rear cover 73, thereby possibly causing deterioration in durability of the rear cover 73. The shaft fixing part 762 may be a disk-shaped plate having a diameter smaller than that of the rear cover 73 as a means for reducing the risk described above.

Since the driving shaft 761 passes through the rear surface of the tub 2 to connect the shaft fixing part 762 and the driven pulley 764, a bearing 763 that rotatably fixes the driving shaft 761 to the tub 2 may be provided on the rear surface of the tub 2.

Although not shown in the drawings, the driving shaft 761 may be provided to be orthogonal to the bottom surface of the cabinet. In this case, the entrance should be provided on the upper surface of the cabinet 1, and the tub and the drum should change the structure such that the tub entrance and the drum entrance face the entrance located on the upper surface of the cabinet 1.

The drum 7 may cause vibration during rotation. When the drum 7 rotates at a high speed in a state in which the laundry is concentrated in a predetermined area of the drum body 71, the drum 7 is rotated in a state in which a dynamic equilibrium (or balance) is broken.

The dynamic equilibrium (balance) of the laundry treatment apparatus may be defined as a case in which the mass distribution of the laundry around the rotation axis of the drum is within an allowable range when the drum rotates. That is, when the drum rotates, the state in which the mass distribution around the rotational axis of the drum is out of the allowable range (i.e., the state in which the drum vibrates out of the allowable range) may be seen in a dynamic imbalance state, and such a state may be generally referred to as an unbalance state.

When the drum rotates in an unbalanced state, vibration generated in the drum may cause a problem of noise induction and durability degradation by vibrating the entire laundry treatment apparatus as well as the tub.

A balancer 8 and 9 may be further provided in the laundry treatment apparatus 100 to resolve (or control) an unbalance state of the drum.

Figure 2:
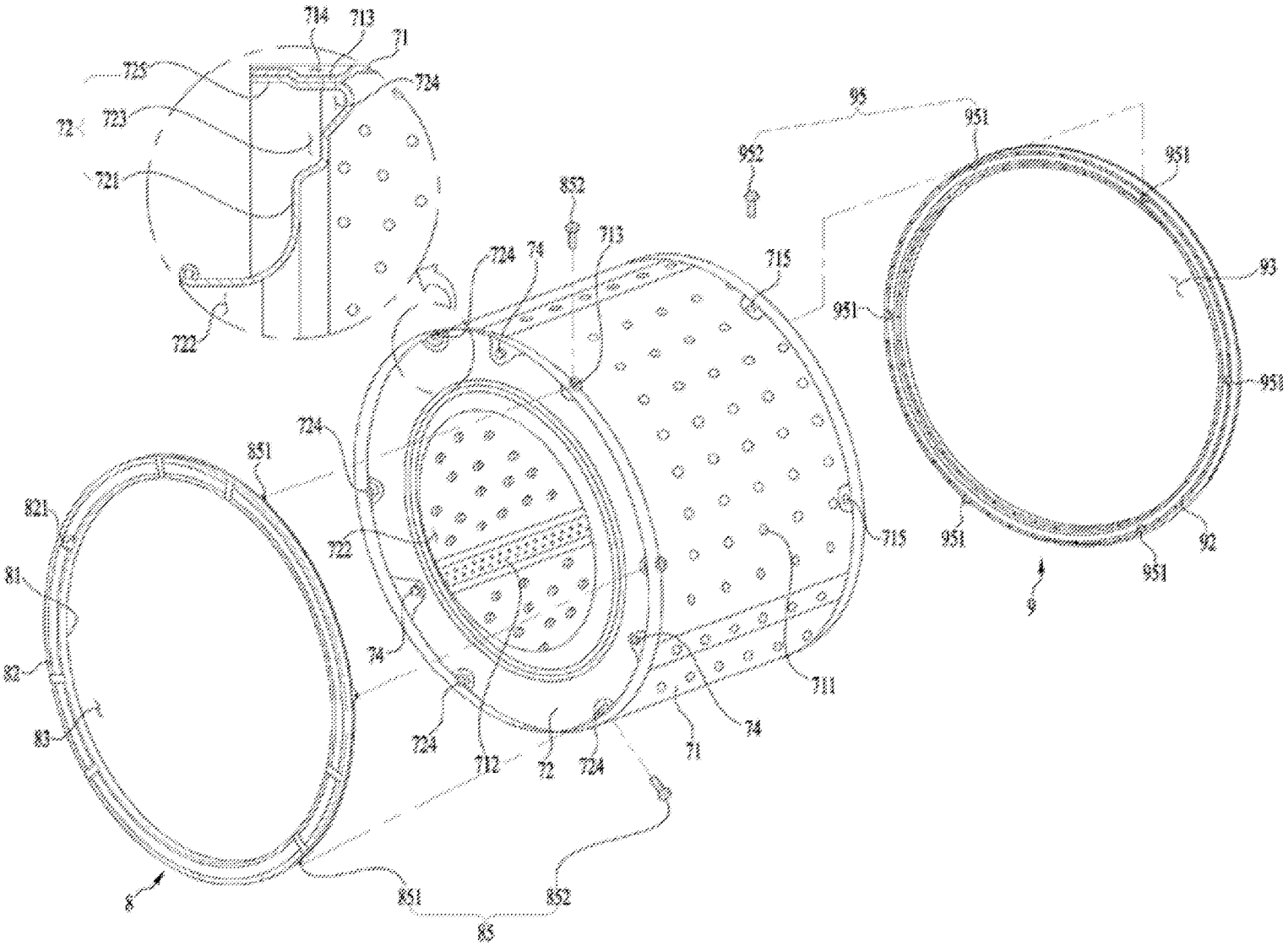
FIG. 2 is a diagram illustrating an example of a drum.

FIG. 1 and FIG. 2 illustrate an example in which the balancer includes both a front balancer 8 fixed to the front surface (front cover 72) of the drum and a rear balancer 9 fixed to the rear surface (rear cover 73) of the drum.

Although not shown in the drawings, the balancer may be provided with either the front balancer 8 or the rear balancer 9.

As shown in FIG. 2, the front balancer 8 includes a ring-shaped body 81 and 82 fixed to the drum body 71 or the front cover 72 to surround the drum entrance 722. The body may include a first body (a front first body) 81 fixed to the drum 7, a second body (a front second body) 82 fixed to the first body 82, and a through-hole (a front through-hole) 83 passing through the first body and the second body to allow the drum entrance 722 to pass therethrough.

Figure 3:
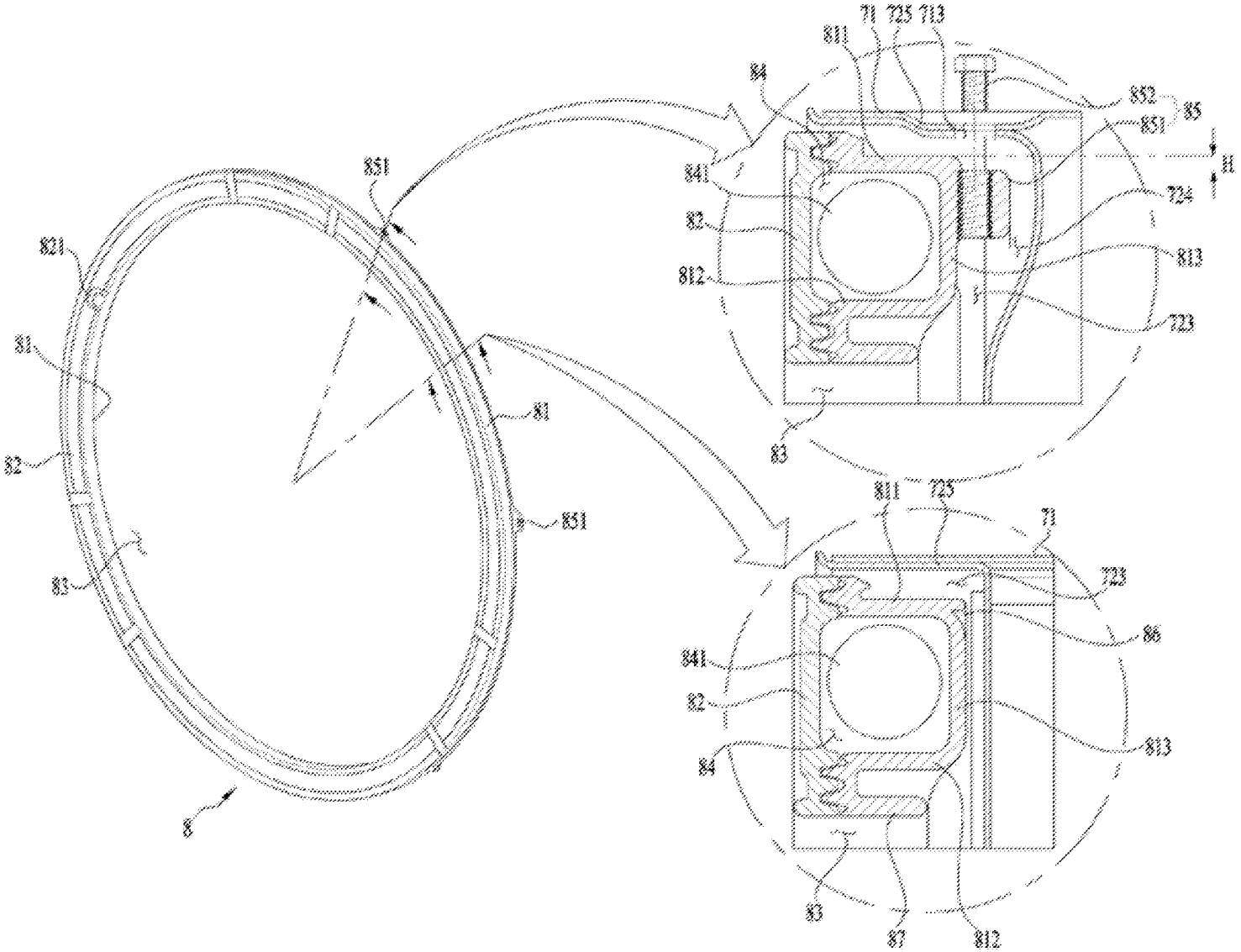
FIGS. 3 to 6 are diagrams illustrating an example of a balancer.

As shown in FIG. 3, the first body 81 may include a base 813 (i.e., a front base) provided in a ring shape surrounding the drum entrance 722, a first surface 811 (i.e., a front first surface) provided in a ring shape along an outer edge of the base 813, and a second surface 812 (i.e., a front second surface) provided in a ring shape along an inner edge of the base 813.

The base 813 may be provided as a ring-shaped plane facing a point where the front cover 72 is located in the first body 81. When the base 813 is provided in a ring shape, an inner circumferential surface (i.e., an inner edge) close to the drum entrance 722 and an outer circumferential surface (i.e., an outer edge) close to the circumferential surface of the drum body 71 are formed on the base 813.

The first surface 811 may be provided as a wall protruding from the outer edge of the base 813 toward a front surface of the tub 2 (i.e., a surface having the tub entrance formed therein), and the second surface 812 may be provided as a wall protruding from the inner edge of the base 813 toward the front surface of the tub 2. Accordingly, the second surface 812 may form a ring-shaped wall surrounding the drum entrance 722, and the first surface 811 may form a ring-shaped wall surrounding the second surface.

An open surface (i.e., a front open surface) is formed between a free end of the first surface 811 and a free end of the second surface 812, and the open surface is closed by the second body 82. Accordingly, a circulation path 84 (i.e., a front circulation path) is formed in the front balancer 8 by the base 813, the first surface 811, the second surface 812, and the second body 82. The circulation path 84 may be a ring-shaped path surrounding the drum entrance 722.

The front balancer 8 is provided with a ball 841 movable along the circulation path 84, and the number of the balls 841 may be provided as many as necessary. A liquid may be stored in the circulation path 84 to prevent the speed of the ball from becoming too fast, and in this case, the second body 82 may be provided with an inlet 821 through which liquid flows into the circulation path 84.

The front balancer 8 is fixed to the drum 7 through a fastening portion 85 (i.e., a front fastening portion). As shown in FIG. 3, the fastening portion 85 may include a fixing body 851 (e.g., a front fixing body) provided in the base 813 and a fastening body 852 for fixing the fixing body 851 to at least one of the drum body 71 and the front cover 72.

FIG. 3 illustrates an example in which the fastening body 852 fixes the fixing body 851 to the drum body 71 and the front cover 72. In this case, the fastening body 852 is a means for coupling the drum body 71 and the front cover 72 as well as a means for fixing the front balancer 8 to the drum 7.

When the fixing body 851 is positioned on the second surface 812, the front balancer 8 should be fixed to the drum entrance 722 or the front cover 72. However, since a diameter of the through-hole 83 is greater than that of the drum entrance 722, it may not be easy to fix the front balancer 8 to the drum entrance 722.

In addition, in order to fix the front balancer 8 to the front cover 72, the fastening body 852 should be provided to be orthogonal to the front cover 72, which may enables a centrifugal force generated from rotation of the drum to cause shear stress on the fastening body, thereby causing a risk of reducing the durability of the drum or the first body and also causing a problem of damaging the laundry inside the drum.

The risk of reducing the durability of the front balancer 8 increases as the diameter of the through-hole 83 increases. In addition, damage to the front balancer may cause problems such as leakage of liquid inside the circulation flow path (this problem corresponds to a more important design solution for a laundry treatment apparatus having a long diameter of a drum, such as a commercial washing machine).

Meanwhile, if the fixing body 851 is provided on the first surface 811 and the fastening body 852 is provided to couple a circumferential surface of the drum body 71 and the fixing body 851 together, the front balancer 8 may be easily fixed to the drum 7 without the above-described problem.

However, when the fixing body 851 is positioned on the first surface 811, the diameter of the circulation path 84 is shortened (the first surface should be moved in the direction in which the drum entrance is positioned to secure a space required for the installation of the fixing body). If the diameter of the circulation path decreases, it means that the centrifugal force acting on the ball 841 decreases during rotation of the drum. If the centrifugal force acting on the ball 841 decreases, it is disadvantageous in that a long time is required to resolve the unbalance of the drum.

When the fixing body 851 is provided to the base 813, there may be an effect that the centrifugal force applied to the ball 841 is maximized to resolve the unbalance state of the drum in a short time.

As shown in FIG. 2, the front cover 72 may include a front cover body 721 having the drum entrance 722, a front mounting portion 723 provided in a ring shape surrounding the drum entrance 722 to the front cover body 721 to mount the base 813 thereon, and a front connection portion 725 extending from the front mounting portion 723 to come in contact with a circumferential surface of the drum body 71. The front mounting portion 723 may be provided as a recess in which the front cover body 721 is bent toward the rear cover 73.

When the drum 7 is rotated, the first surface 811 may be deformed by a centrifugal force. If the front cover 72 has the structure described above, the front connection portion 725 may serve to suppress the deformation of the first surface 811.

When the fixing body 851 is provided to protrude from the base 813 toward the front mounting portion 723, the front mounting portion 723 may further include a front mounting recess 724 in which the fixing body 851 is accommodated.

The front mounting recess 724 may be provided as a recess formed by bending the front mounting portion 723 toward the rear cover 73. A multitude of fixing bodies 851 may be provided. The fixing bodies 851 may be provided at positions spaced apart from each other by the same angle with respect to the center of the through-hole 83, respectively. The number of the front mounting recesses 724 may be set equal to the number of the fixing bodies 851.

The fastening body 852 may be inserted into a first fixing hole 713 to fix the fixing body 851 to the drum body 71, and the first fixing hole 713 may be provided in a manner of passing through the circumferential surface of the drum body 71 and the front connection portion 725 to be connected to the front mounting recess 724.

When the fixing body 851 is inserted into the front mounting recess 724, a fastening force between the front balancer 8 and the drum 7 may be increased.

Figure 4:
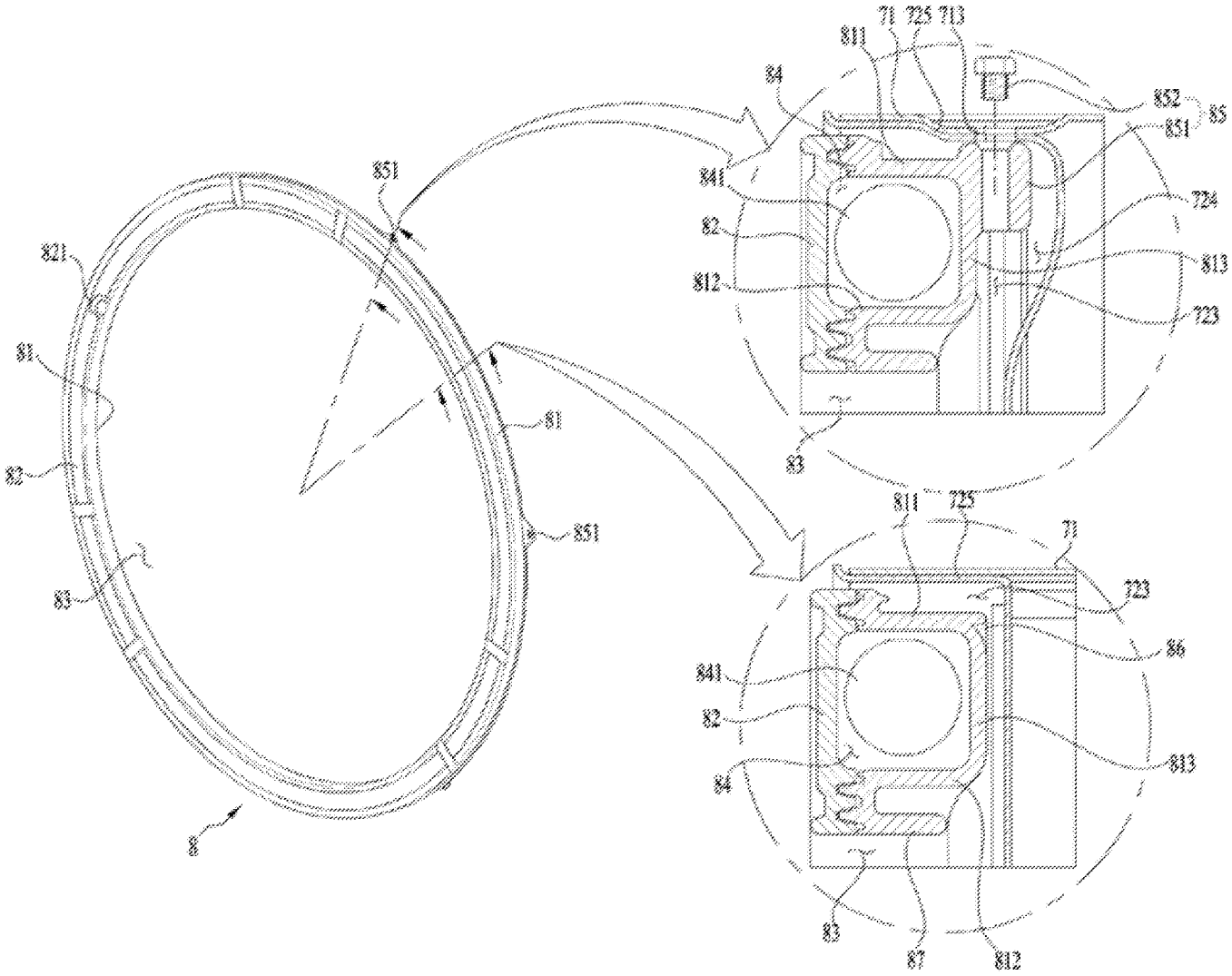

A height of an upper end of the fixing body 851 may be provided to a position H that is the same as or lower than a height of the first surface 811 as shown in FIG. 3, or may be disposed at a position higher than the height of the first surface 811 as shown in FIG. 4.

The structure of the fixing body 851 of FIG. 4 not only maximizes a centrifugal force acting on the ball 841 but also supports the fixing body 851 to the front connection portion 725, thereby minimizing deformation of the body 81 and 82.

In order to minimize deformation of the first surface 811 due to the centrifugal force generated from the rotation of the drum 7, the front balancer 8 may further include a first reinforcing portion 86 (i.e., a front first reinforcing portion).

Figure 5:
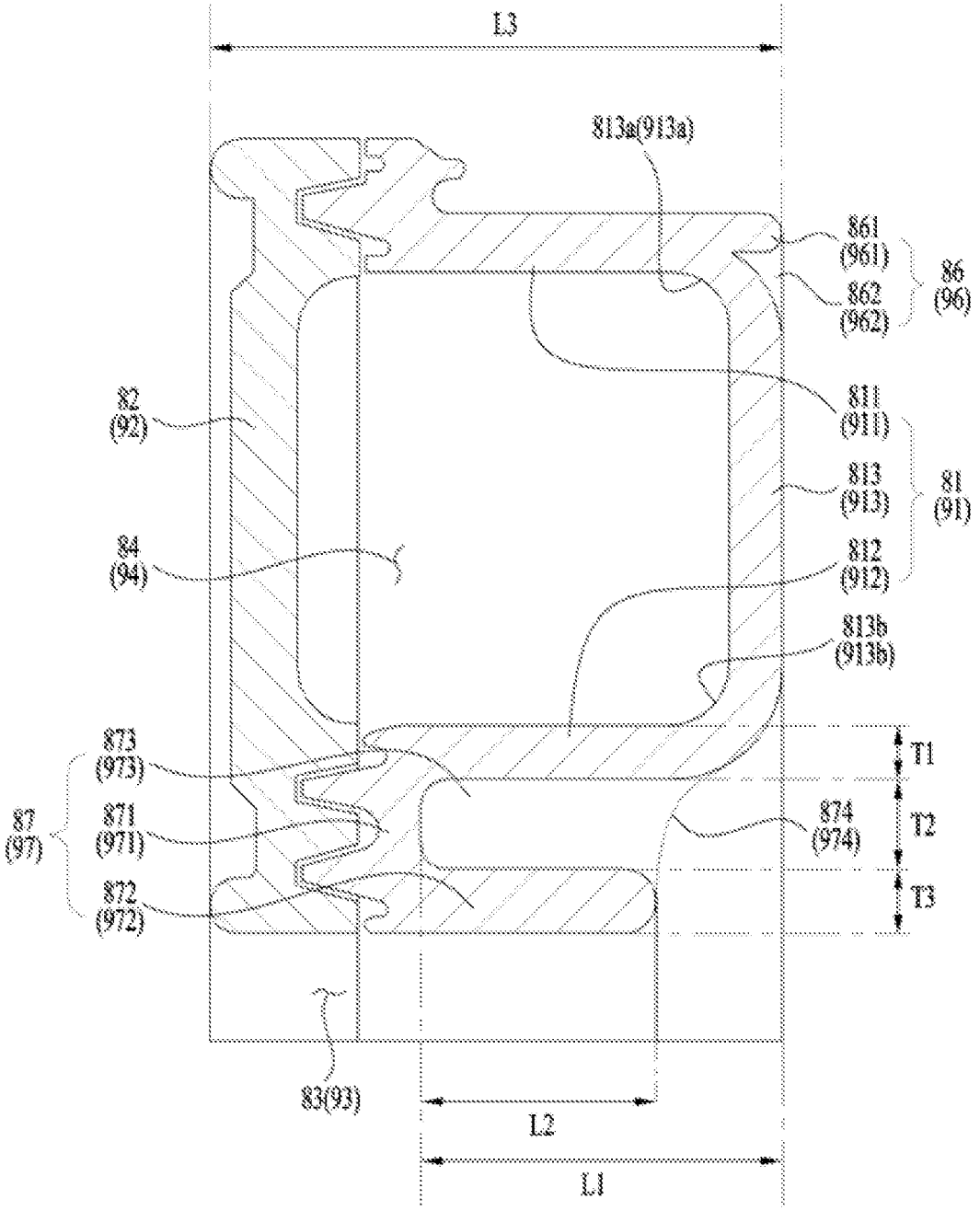

As shown in FIG. 5, the first body 81 may include a first connection surface 813*a* (i.e., a front first connection surface) positioned at a corner where the first surface 811 and the base 813 are connected and a second connection surface 813*b* (i.e., a front second connection surface) positioned at a corner where the second surface 812 and the base 813 are connected. The first connection surface 813*a* may be provided as a curved surface bent from the base 813 toward the first body 811, and the second connection surface 813*b* may be provided as a curved surface bent from the base 813 toward the second body 812.

The first reinforcing portion 86 may include a first extension portion 861 (i.e., a front first extension portion) protruding from the first surface 811 toward the front cover 72 (toward the front mounting portion) and a first support portion 862 (i.e., a front first support portion) having one end fixed to the first extension portion 861 and the other end fixed to the first connection surface 813*a*. The first support portion 862 is a means for not only minimizing deformation of the first extension portion 861 but also maintaining a gap between the first extension portion 861 and the first connection surface 813*a*.

Preferably, a distance L3 from the second body 82 to a free end of the first extension portion 861 is set to be the same as a distance from the second body 82 to an outer circumferential surface of the base 813 (i.e., the free end of the first extension portion is disposed on the same plane as the base). This is to minimize a space required for the front cover 72 to mount the front balancer 8.

The first support portion 862 may include a multitude of ribs (i.e., first support plates) spaced apart from each other at the same interval with respect to the center of the through-hole 83 (i.e., the center of the drum entrance). Although not shown in the drawings, the first reinforcing portion 86 may include either the first extension portion 861 or the first support portion 862.

Figure 6:
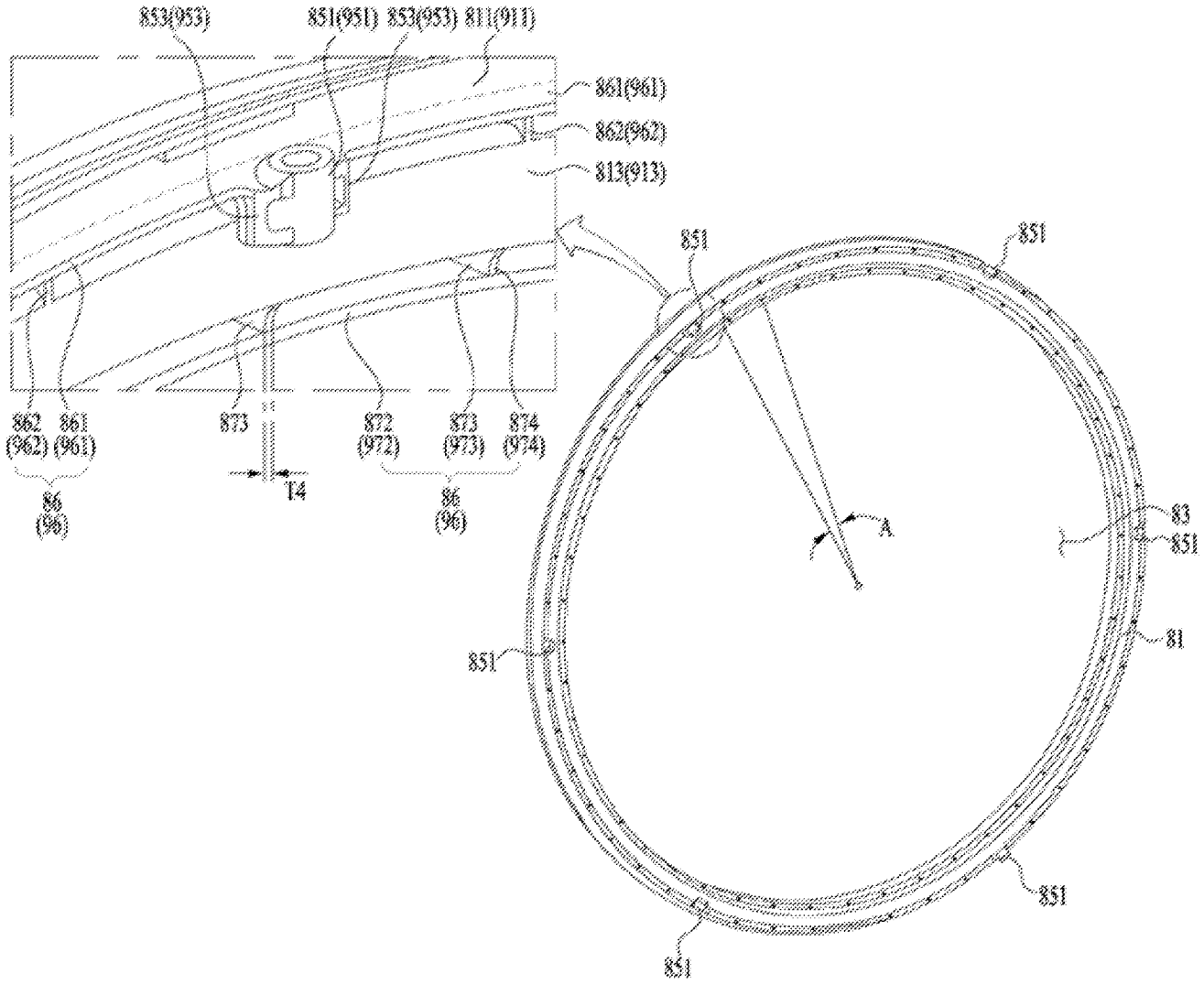

As shown in FIG. 6, when the first extension portion 861 is provided, the fixing body 851 may be provided to connect the first extension portion 861 and the base 813. When the fixing body 851 is provided as described above, the possibility of deformation of the first extension portion 861 and the first surface 811 may be further reduced.

In order to minimize the deformation of the first surface 811 and the base 813 due to the centrifugal force and increase the durability of the fixing body 851, the front balancer 8 may further include a fixing body support portion 853 (i.e., a front fixing body support portion).

The fixing body support portion 853 may be a means for connecting the first extension portion 861, the fixing body 851, and the base 813, and may include a support body connecting the first extension portion 861 and the base 813, an upper connection body connecting an upper end of the support body to the fixing body 851 and a lower connection body connecting a lower end of the support body and the fixing body 851.

Preferably, the fixing body support portion 853 may include a fixing body first support portion provided on the left side of the fixed body 851 and a fixing body second support portion provided on the right side of the fixed body 851.

In order to minimize deformation of the second surface 812 due to a centrifugal force generated during rotation of the drum 7, the front balancer 8 may further include a second reinforcing portion 87 (i.e., a front second reinforcing portion).

As shown in FIG. 5, the second reinforcing portion 87 may include a protruding portion 871 (i.e., a front protruding portion) protruding from the second surface 812 toward the drum entrance 722. When the protruding portion 871 is provided on the second surface 812 forming the through-hole 83, deformation of the second surface 812 due to the centrifugal force may be minimized.

The second reinforcing portion 87 may further include a second extension portion 872 (i.e., a front second extension portion) extending from the protruding portion 871 toward the front cover 72 (extending toward the front mounting portion). The second extension portion 872 may form a ring-shaped wall (i.e., the through-hole) surrounding the drum entrance 722.

When the second extension portion 872 is provided, the second reinforcing portion 87 may further include a second support portion 873 (i.e., a front second support portion) having one end fixed to the second extension portion 872 and the other end fixed to the second connection surface 813*b*.

The second support portion 873 may be provided as a multitude of ribs (i.e., second support plates) spaced apart from each other at the same interval with respect to the center of the through-hole 83 (based on the center of the drum entrance).

As shown in FIG. 6, the second support portion 873 may be provided as a multitude of ribs spaced apart at the same angle A with respect to the center of the through-hole 83 (i.e., the center of the base). According to the experiment, it is confirmed that the deformation of the front balancer 8 may be effectively prevented when the angle A is set to 7 to 15 degrees. Further, it is preferable that a thickness T4 of the second support portion 873 is set to ½ times or more of a thickness T4 of the second surface 812.

As shown in FIG. 5, a distance L2 from the protruding portion 871 to the free end of the second extension portion 872 may effectively prevent deformation of the second surface 812 when it is set to ½ times or more of the distance L1 from the protruding portion 871 to the outer circumferential surface of the base 813.

Figure 7:
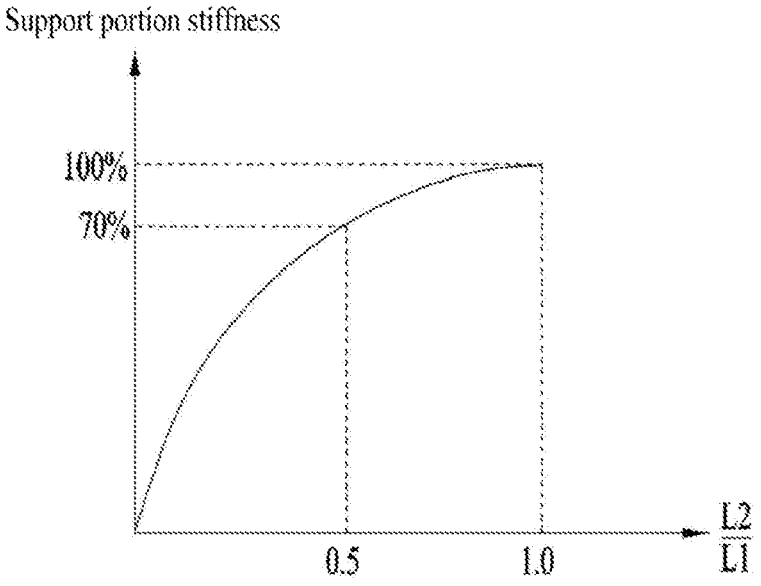
FIG. 7 is a graph illustrating a change in stiffness of a second reinforcing portion according to a length ratio of a second surface and a second extension portion provided in a balancer.

FIG. 7 is a graph related to a change in stiffness of the second support portion 873 according to a ratio of a length L2 of the second extension portion 872 to a length L1 of the second surface 812. According to the graph of FIG. 7, when the length ratio (L2/L1) of L2 to L1 is less than 0.5, the stiffness of the second support portion 873 is greatly changed according to the length ratio. Yet, when the length ratio is 0.5 or more, the stiffness change of the second support portion 873 is not large. Therefore, it can be seen that the length ratio of L2 to L1, which realizes the greatest effect at a minimum cost, is greater than or equal to 0.5 and smaller than or equal to 1.

As shown in FIG. 5, when the length L2 of the second extension portion 872 is set to be shorter than the length L1 of the second surface 812, it is preferable that the free end of the second support portion 873 is provided with an inclined portion 874 (i.e., a front inclined portion). This is because the second surface 812 is prevented from being deformed as the width of the second support portion 873 increases. The inclined portion 873 may be provided as an inclined surface connecting the second connection surface 813*b* from a free end of the second extension portion 872.

A thickness T3 of the second extension portion 872 is effective for preventing deformation of the second surface 812 when it is set to be smaller than or equal to the thickness T1 of the second surface 812. And, it is confirmed that it is most effective when the thickness T3 of the second extension portion 872 is set to 0.7 to 0.9 times of the thickness T1 of the second surface 812.

Meanwhile, the height T2 of the second support portion 873 connecting the second surface 812 and the second extension portion 872 is effective for preventing deformation of the second surface 812 when set to 0.3 times or more of the distance L2 from the protruding portion 871 to the free end of the second extension portion 872.

Figure 8:
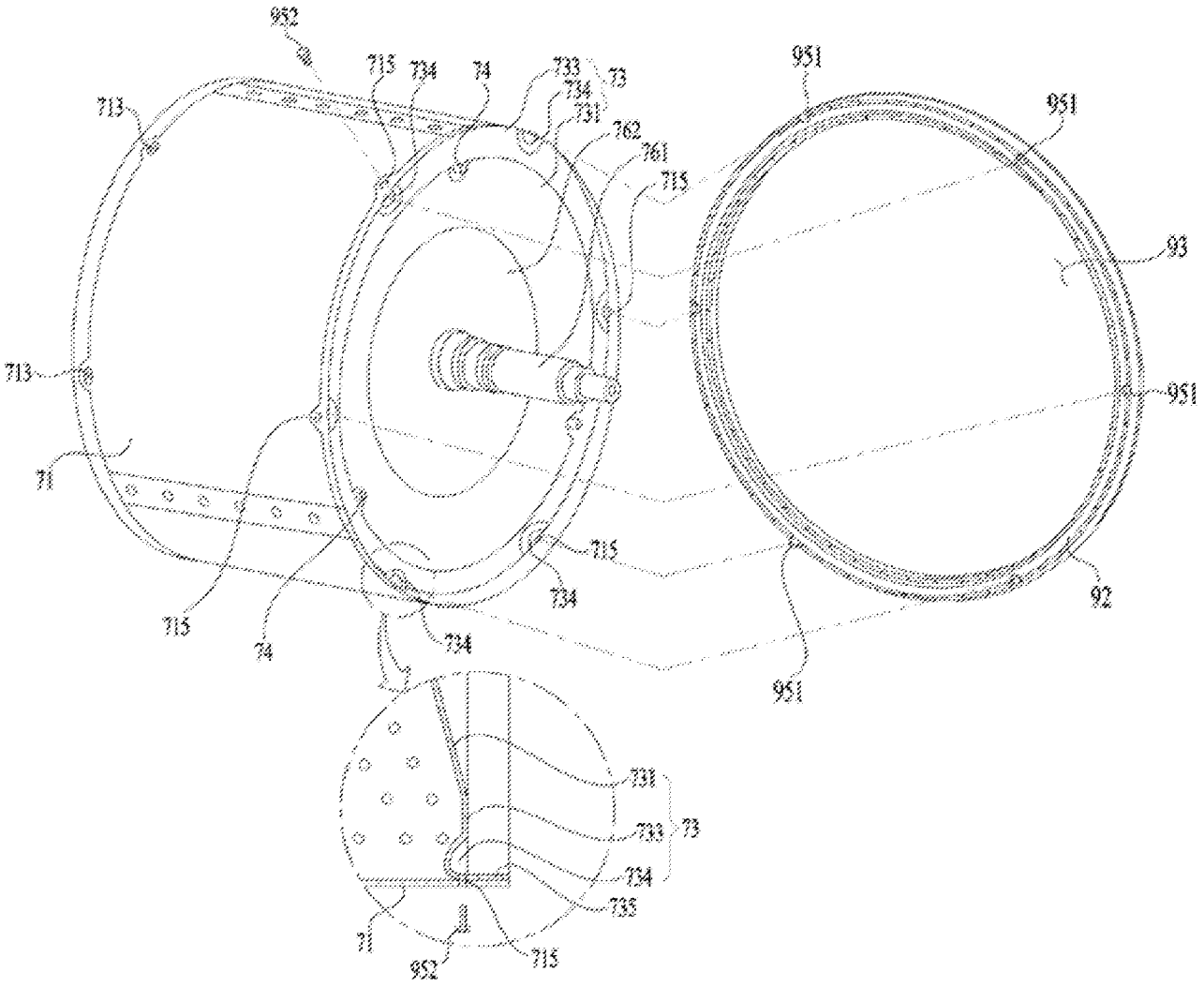
FIG. 8 is a diagram illustrating an example of a rear balancer.

FIG. 8 illustrates an example of the rear balancer 9, and the structure of the rear balancer 9 may be the same as the structure of the front balancer 8 described above.

That is, the rear balancer 9 includes a ring-shaped rear body 91 and 92 surrounding the driving shaft 791 by being fixed to the drum body 71 or the rear cover 73. The rear body may include a rear first body 91 fixed to the drum 7, a rear second body 92 fixed to the rear first body, and a rear through-hole 93 provided to pass through the rear first body and the rear second body to enable the driving shaft 791 to pass therethrough.

Figure 9:
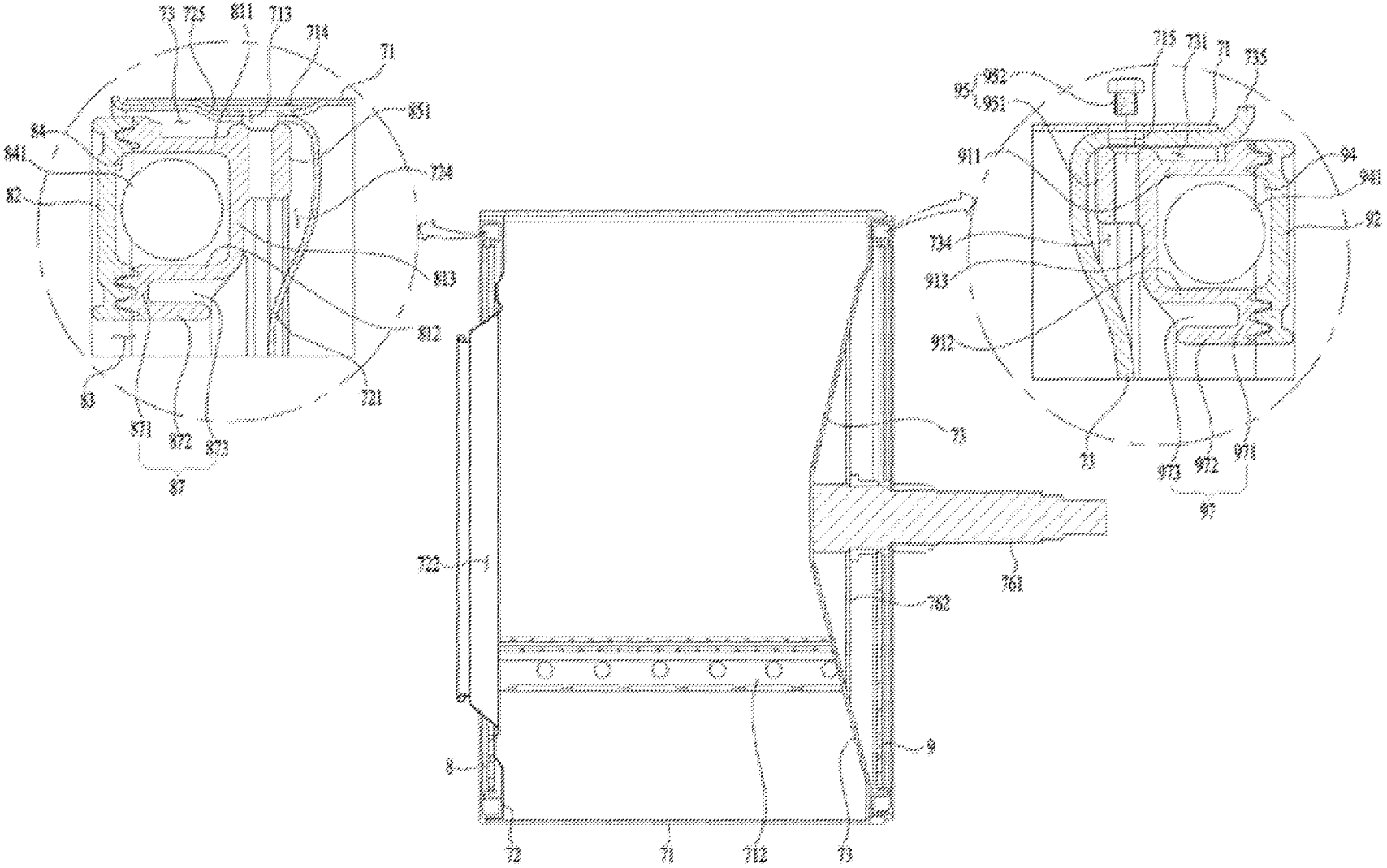
FIG. 9 is a diagram illustrating an example of a coupling structure of a front balancer, a drum, and a rear balancer.

As shown in FIG. 9, the rear first body 91 includes a rear base 913 provided in a ring shape surrounding the driving shaft 761, a ring-shaped rear first surface 911 provided along an outer edge of the rear base 913, and a ring-shaped rear second surface 912 provided along an inner edge of the rear base 813.

The rear base 913 may be provided as a ring-shaped plane facing a point where the rear cover 73 is located in the rear first body 91. When the rear base 913 is provided in a ring shape, an inner circumferential surface (i.e., an inner edge) close to the driving shaft 761 and an outer circumferential surface (i.e., an outer edge) close to the circumferential surface of the drum body 71 are formed on the rear base 913.

The rear first surface 911 may be provided as a wall protruding from the outer edge of the rear base 913 toward the rear surface of the tub 2, and the rear second surface 912 may be provided as a wall protruding from the inner edge of the rear base 913 toward the rear surface of the tub 2. Accordingly, the rear second surface 912 may form a ring-shaped wall surrounding the driving shaft 761 and the rear first surface 911 may form a ring-shaped wall surrounding the rear second surface.

An open surface is formed between a free end of the rear first surface 911 and a free end of the rear second surface 912, and the open surface is closed by the rear second body 92. Accordingly, the rear balancer 9 has a rear circulation path 94 formed by the rear base 913, the rear first surface 911, the rear second surface 912, and the rear second body 92. The rear circulation path 94 may be a ring-shaped path surrounding the driving shaft 761.

A ball 941 (i.e., a rear ball) movable along the rear circulation path 94 may be provided in the rear balancer 9, and a liquid may be stored in the rear circulation path 94 to prevent the speed of the ball from becoming too fast.

The rear balancer 9 is fixed to the drum 7 through a rear fastening portion 95. The rear fastening portion 95 may include a rear fixing body 951 provided on the rear base 913 and a rear fastening body 952 for fixing the rear fixing body 951 to at least one of the drum body 71 and the rear cover 73. FIG. 9 illustrates an example in which the rear fastening body 952 fixes the rear fixing body 951 to the drum body 71 and the rear cover 73.

When the rear fixing body 951 is provided on the rear base 913, a centrifugal force applied to the ball 941 is maximized to bring an effect of resolving an unbalance state of the drum in a short time.

A height of an upper end of the rear fixing body 951 may be provided at a position H equal to a height of the rear first surface 911 or lower than the height of the first surface 811, or may be located at a position higher than the height of the rear first surface 911. And, FIG. 9 illustrates the latter case as an example.

As shown in FIG. 8, the rear cover 73 may include a rear cover body 731 to which the driving shaft 761 is fixed, a rear mounting portion 733 provided in a ring shape surrounding the driving shaft 761 on the rear cover body 731 to have the rear base 913 mounted thereon, and a rear connection portion 735 extending from the rear mounting portion 733 to come in contact with the circumferential surface of the drum body 71.

When the drum 7 rotates, the rear first surface 911 may be deformed by a centrifugal force. If the rear cover 73 has the structure described above, the rear connection portion 735 may serve to suppress deformation of the rear first surface 911.

When the rear fixing body 951 is provided to protrude from the rear base 913 toward the rear mounting portion 733, the rear mounting portion 733 may further include a rear mounting recess 734 in which the rear fixing body 951 is accommodated. The rear mounting recess 734 may be provided as a recess formed by bending the rear mounting portion 733 toward the front cover 72.

A multitude of rear fixing bodies 951 may be provided. The rear fixing bodies 951 may be provided at positions spaced apart from each other by the same angle with respect to the center of the rear through-hole 93, respectively. And, the number of the rear mounting recesses 734 should be equal to the number of rear fixing bodies 951.

The rear fastening body 952 may be inserted into a second fixing hole 715 to fix the rear fixing body 951 to the drum body 71, and the second fixing hole 715 may pass through the circumferential surface of the drum body 71 and the rear connection portion 735 to be connected to the rear mounting recess 734.

When the rear fixing body 951 is inserted into the rear mounting recess 734, a fastening force between the rear balancer 9 and the drum 7 may be increased.

The laundry treatment apparatus having the above-described structure may resolve an unbalance state of the drum in a short time, and may minimize a space required for the rear cover 73 to mount the rear balancer 9.

In order to minimize deformation of the rear first surface 911 and the rear second surface 912 due to a centrifugal force generated during rotation of the drum 7, at least one of a rear first reinforcing portion 96 and a rear second reinforcing portion 97 may be further provided in the rear balancer 9.

The structure of the rear first reinforcing portion 96 and the rear second reinforcing portion 97 may be provided to be the same as the structure of the first reinforcing portion 86 and the second reinforcing portion 87 of the front balancer described above.

As shown in FIG. 5, the rear first body 91 may include a rear first connection surface 913*a* located at a corner where the rear first surface 911 and the rear base 913 are connected and a rear second connection surface 913*b* located at a corner where the rear second surface 912 and the rear base 913 are connected. The rear first connection surface 913*a* may be provided as a curved surface bent from the rear base 913 toward the rear first body 911, and the rear second connection surface 913*b* may be provided as a curved surface bent from the rear base 913 toward the rear second body 912.

In this case, the rear first reinforcing part 96 may include a rear first extension portion 961 protruding from the rear first surface 911 toward the rear cover 73 and a rear first support portion 962 having one end fixed to the rear first extension portion 961 and the other end fixed to the rear first connection surface 913*a*. The rear first support portion 962 may be provided as a multitude of ribs (i.e., rear first support plates) spaced apart from each other at the same interval with respect to the driving shaft 761.

As shown in FIG. 6, when the rear first extension portion 961 is provided, the rear fixing body 951 may be provided to connect the rear first extension portion 961 and the rear base 913, and the rear fixing body support portion 953 may be provided on both sides of the rear fixing body 951.

The rear fixing body support portion 953 may be a means for connecting the rear first extension portion 961, the rear fixing body 951, and the rear base 913, and may include a support body connecting the rear first extension portion 961 and the rear base 913, an upper connection body connecting an upper end of the support body to the rear fixing body 951, and a lower connection body connecting a lower end of the support body and the rear fixing body 951.

Preferably, the rear fixing body support portion 953 includes a rear fixing body first support portion provided on the left side of the rear fixing body 951 and a rear fixing body second support portion provided on the right side of the rear fixing body 951.

As shown in FIG. 5, the rear second reinforcing portion 97 may include a rear protruding portion 971 protruding from the rear second surface 912 toward the rotational center of the drum (i.e., the driving shaft), a rear second extension portion 972 extending from the rear protruding portion 971 toward the rear cover 73, and a rear second support portion 973 having one end fixed to the rear second extension portion 972 and the other end fixed to the rear second connection surface 913*b*.

The rear second support portion 973 may be provided as a multitude of ribs (i.e., rear second support plates) spaced apart from each other at the same interval with respect to the center of the rear through-hole 93, and a rear inclined portion 974 may be provided at a free end of the rear second support portion 973.

The rear second reinforcing portion 97 may include only the rear protruding portion 971, may include only the rear protruding portion 971 and the rear second support portion 973, or may include only the rear protruding portion 971 and the rear second extension portion 972. The second reinforcing portion 87 provided to the front balancer is also the same.

Since the thickness, length, and disposition of the rear first reinforcing portion 96 and the rear second reinforcing portion 97 described above are the same as those of the first reinforcing portion 86 and the second reinforcing portion 87 of the front balancer 8 described above, a detailed description thereof will be omitted.

As shown in FIG. 9, the thickness of the front cover 72 and the thickness of the rear cover 73 may be set differently. Considering that the rear cover 73 receives an external force from the driving shaft 761, the thickness of the rear cover 73 is preferably set to be thicker than the thickness of the front cover 72.

In this case, the drum body 71 may further include an accommodation recess 714 for moving the first fixing hole 713 toward the direction in which the drum entrance 722 is positioned. When the front balancer 8 and the rear balancer 9 are designed in the same structure and the thicknesses of the front cover 72 and the rear cover 73 are differently set, the position of the first fixing hole 713 should be moved to a point in contact with the fixing body 851 of the front balancer 8, whereby the durability degradation of the front balancer 8 may be minimized.

Inside the circulation paths 84 and 94 of the front balancer 8 and the rear balancer 9 provided in the above-described embodiment, only balls 841 and 941, both a ball and a liquid, or only the liquid may be provided.

As the above-described laundry treatment apparatus may be modified and implemented in various forms, the scope of the rights of the present application is non-limited to the above-described embodiments.

What is claimed is:

1. A laundry treatment apparatus, comprising;

a cabinet having an entrance;

a tub provided in the cabinet and defining a space configured to receive water, the tub having a tub entrance connected to the entrance of the cabinet;

a drum rotatably provided in the tub and defining a space configured to receive laundry supplied through the tub entrance, the drum comprising (i) a drum body that has a cylindrical shape and is positioned inside the tub, the drum body defining a communication hole, (ii) a front cover defining a drum entrance that faces the tub entrance and is configured to receive the laundry into the drum body, and (iii) a rear cover provided at a position opposite to the front cover; and a balancer comprising:

a base that is fixed to the drum and has a ring shape surrounding a rotation center of the drum;

a first surface having a ring shape along an outer edge of the base, a second surface having a ring shape along an inner edge of the base and defining a circulation path together with the base and the first surface, a ball movable along the circulation path, a fastening portion that is provided to the base and fixes the balancer to the drum, and a reinforcing portion that protrudes from the second surface toward the rotation center of the drum and configured to reinforce a strength of the second surface, wherein the reinforcing portion comprises:

a protruding portion that protrudes from the second surface toward the drum entrance, an extension portion that extends from the protruding portion toward the front cover and has a ring shape surrounding the drum entrance, and a support portion having a first end fixed to the extension portion and a second end fixed to the second surface, the support portion being configured to maintain a gap between the extension portion and the second surface.

2. The laundry treatment apparatus of claim 1, wherein the balancer is fixed to the front cover.

3. The laundry treatment apparatus of claim 2, wherein the fastening portion comprises:

a fixing body provided on the base; and a fastening body fixing the fixing body to at least one of the drum body or the front cover.

4. The laundry treatment apparatus of claim 3, wherein a height of an uppermost end of the fixing body is set to be smaller than a height of an uppermost end of the first surface.

5. The laundry treatment apparatus of claim 3, wherein the front cover comprises:

a front cover body having the drum entrance;

a front mounting portion provided in a ring shape surrounding the drum entrance to the front cover body to have the base mounted thereon; and a front connection portion extending from the front mounting portion to come in contact with the drum body, wherein the fixing body and the front connection portion are fixed to the drum body through the fastening body.

6. The laundry treatment apparatus of claim 5, wherein the fixing body protrudes from the base toward the front mounting portion and wherein the front mounting portion comprises a front mounting recess having the fixing body accommodated therein.

7. The laundry treatment apparatus of claim 5, wherein the balancer further comprises a first extension portion extending from the first surface toward the front mounting portion, wherein the fixing body connects the first extension portion and the base.

8. The laundry treatment apparatus of claim 7, wherein the balancer further comprises:

a first connection surface located at a corner where the first surface and the base are connected, the first connection surface being curved from the base toward the first surface; and a first support portion having one end fixed to the first extension portion and another end fixed to the first connection surface, the first support portion being configured to maintain a gap between the first extension portion and the first connection surface.

9. The laundry treatment apparatus of claim 1, wherein the balancer further comprises:

a connection surface located at a corner where the second surface and the base are connected, the connection surface being curved from the base toward the second surface, and wherein the support portion has another end fixed to the connection surface and is configured to maintain a gap between the extension portion and the connection surface.

10. The laundry treatment apparatus of claim 1, wherein a distance from the protruding portion to a free end of the extension portion is equal to or more than half of a distance from the protruding portion to an outer circumferential surface of the base.

11. The laundry treatment apparatus of claim 10, wherein the support portion comprises an inclined portion connecting the connection surface to the free end of the extension portion.

12. The laundry treatment apparatus of claim 9, wherein a thickness of the extension portion is equal to or smaller than a thickness of the second surface.

13. The laundry treatment apparatus of claim 1, wherein the balancer is fixed to the rear cover.

14. The laundry treatment apparatus of claim 13, wherein the fastening portion comprises:

a rear fixing body provided to the base; and a rear fastening body fixing the rear fixing body to at least one of the drum body or the rear cover.

15. The laundry treatment apparatus of claim 14, wherein a height of an uppermost end of the rear fixing body is set to be smaller than a height of an uppermost end of the first surface.

16. The laundry treatment apparatus of claim 14, further comprising a driving unit configured to rotate the drum through a driving shaft fixed to the rear cover, wherein the rear cover comprises a rear cover body having the driving shaft fixed thereto, a rear mounting portion provided in a ring shape surrounding the driving shaft to the rear cover body to provide a space having the base mounted therein, and a rear connection portion extending from the rear mounting portion to come in contact with the drum body and wherein the rear fixing body and the rear connection portion are fixed to the drum body through the rear fastening body.

17. The laundry treatment apparatus of claim 1, wherein the second surface extends forward from the base, and the extension portion extends rearward from the protruding portion, and wherein the support portion extends radially inward from the second surface and connects to the extension portion.

18. The laundry treatment apparatus of claim 1, wherein the second surface and the extension portion are spaced apart from each other in a radial direction of the drum body and define the gap between the extension portion and the second surface in the radial direction, and wherein the support portion extends from the second surface in the radial direction and connects to the extension portion.

19. The laundry treatment apparatus of claim 1, wherein the balancer further comprises:

a first extension portion extending rearward from the first surface;

a first connection surface located at a corner between the first surface and the base and curved from the base toward the first surface; and a first support portion having one end fixed to the first extension portion and another end fixed to the first connection surface, the first support portion being configured to maintain a gap between the first extension portion and the first connection surface, wherein the extension portion that extends from the protruding portion toward the front cover is a second extension portion of the balancer, and wherein the support portion having the second end fixed to the second surface is a second support portion of the balancer.

* * * * *